US005193586A

United States Patent [19]

Nolin, Jr.

[11] Patent Number: 5,193,586

[45] Date of Patent: Mar. 16, 1993

[54] GRAIN CHUTE VALVE

[76] Inventor: Karl W. Nolin, Jr., 1510 Country Club La., Spencer, Iowa 51301

[21] Appl. No.: 851,062

[22] Filed: Mar. 13, 1992

[51] Int. Cl.[5] ..... F16K 11/00

[52] U.S. Cl. ..... 137/875; 137/878

[58] Field of Search ..... 137/875, 878, 872

[56] References Cited

U.S. PATENT DOCUMENTS

| | | | |
|---|---|---|---|
| 325,449 | 9/1885 | Schueler | 137/875 |
| 2,182,378 | 12/1939 | Gunn | 137/875 |
| 3,570,539 | 3/1971 | Herring | 137/875 X |
| 4,986,308 | 1/1991 | Champseaux | 137/875 X |

FOREIGN PATENT DOCUMENTS

| | | | |
|---|---|---|---|
| 1944387 | 3/1971 | Fed. Rep. of Germany | 137/875 |
| 0067818 | 6/1977 | Japan | 137/875 |

*Primary Examiner*—John C. Fox

[57] ABSTRACT

A grain chute valve providing an enclosed valve member which will avoid leakage of grain between the valve member and the walls of the valve. Either two-way or three-way valves can be produced using the enclosed valve member of the invention.

1 Claim, 3 Drawing Sheets

GRAIN CHUTE VALVE

BACKGROUND AND SUMMARY OF THE INVENTION

This invention pertains to grain valves designed to divert grain into one of a plurality of chutes, and more particularly to such a valve having side walls especially designed to avoid catching of grain between the valve member and the side walls with resultant cracking of the grain.

In handling of grain either for placing the grain in storage or for removal from storage and subsequent mixing for animal feed, it may often be desirable to run the grain from a single source into a selected one of a number of chutes. Thus, when grain is to be stored and one bin is filled, it may be desired simply to run grain from the same source into a second or third bin. At such times, a simple valve to change the direction of flow of grain becomes highly desirable.

Currently there are two types of such valves: A vane or damper type valve and a pan or bucket type. The vane or damper type valve changes the direction of grain flow to either of the two outlets by directing the grain with a plate pivoted from the bottom end. The plate is pivoted to a positive stop to cover one of the two outlets. It is sometimes held to this stop by an over-center spring to ensure that when damper is in a vertical position, vibration does not dislodge the damper, thus causing it to redirect the grain. Grain flowing against the damper exerts pressure on the vane towards the stop. The problem with the vane type valve is that leakage is allowed because of imperfect fit of the vane to the valve body.

Sheet metal is frequently not quite flat and often warps in the welding process. Thus, it is difficult to fit a steel vane inside the sheet steel housing with close enough tolerances to prevent leakage. Therefore, it is common practice to undersize the vane about a quarter of an inch or more and attach to the vane a strip of flexible material such as belting which acts as a gasket between the vane and the housing. This improves the valve's ability to seal when new but since the gasket material has much less abrasion resistance than steel, the material flowing through the valve erodes the rubber gasket on the vane allowing ever increasing leakage.

A pan valve is another type of valve which is manufactured in both Y and offset style. The pan valve includes an entrance collar inserted into the top of the valve. The collar is, in effect, a spout having a discharge end somewhat smaller than the inlet. This inlet collar directs the grain into an internal V-shaped pan pivoted centrally, but not pivoted to any stop and only held in position by a spring. When the valve is set to change the flow direction of the grain, the velocity of the incoming grain or other flowable materials can be very significant if the grain has accelerated down a long spout so the impact often partially overcomes the spring tension. The strength of the spring tension also weakens with time, causing two problems. One is that slight movement of the open top pan may allow grain to leak over the back side. This is very difficult to detect and may result in excessive leakage. The second problem is that sometimes the velocity is so great and the impact so great that it actually forces the pan to turn to the wrong discharge by causing the pan to pass the center position by overcoming the spring resistance.

By my invention, I provide sidewalls fixed to the vane so that the grain is always fully enclosed in a chute and there is no movement between the vane and the walls in any part of the valve where grain is present. I also provide in pan type valve in which the curved sidewall of the chute and positive stop improves the performance of the valve.

DESCRIPTION

Figure 6:
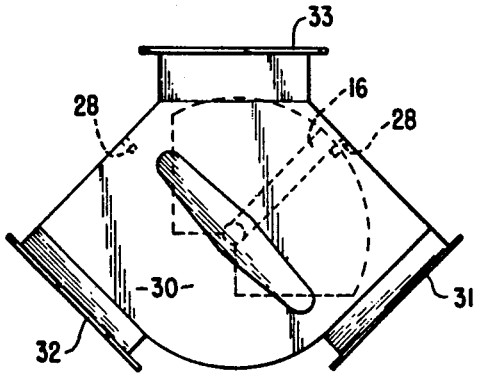
FIG. 6 is a side elevational view of another type of two-way valve housing in which the invented valve may be embodied.
Figure 1:
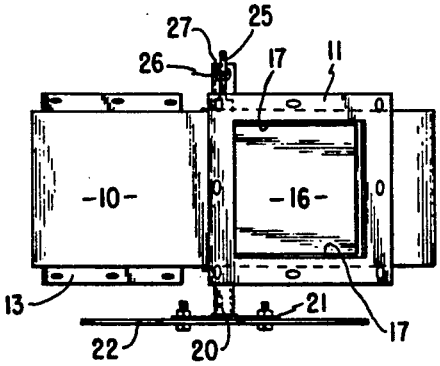
FIG. 1 is a top view of a valve embodying the invention.
Figure 3:
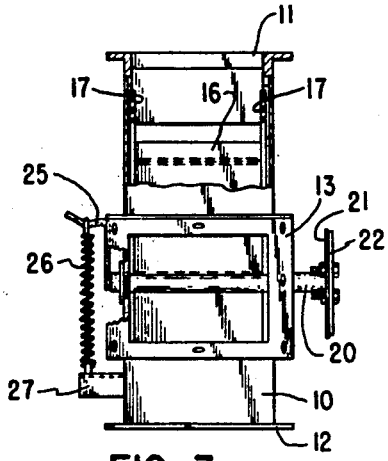
FIG. 3 is an edge elevational view of the valve of FIGS. 1 and 2 with a portion of the housing broken away along line 3—3 of FIG. 2.
Figure 2:
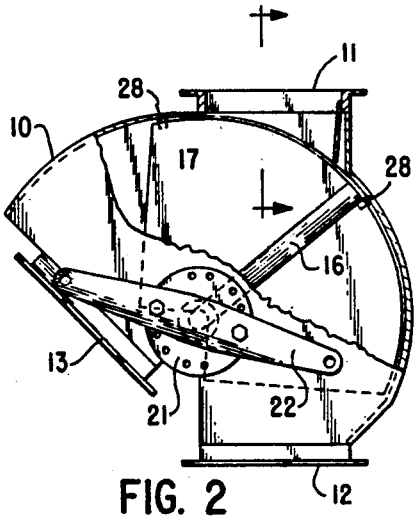
FIG. 2 is a side elevational view of the valve in FIG. 1.
Figure 4:
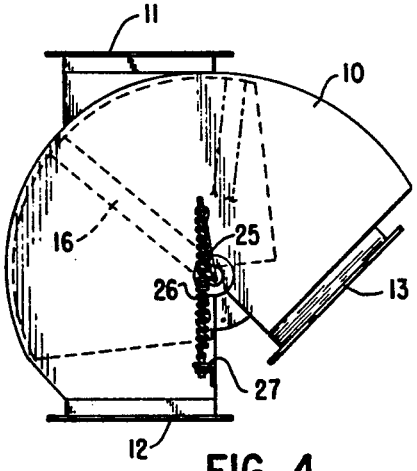
FIG. 4 is a side elevational view of the valve from the side opposite in FIG. 2 and showing the spring holding device for the valve member.

Briefly my invention comprises a valve for controlling the flow of grain into selected chutes. The valve is designed with a valve operating member to enclose the flow so that the grain cannot be caught between the valve member and the side walls of the valve housing.

More specifically and referring to the drawings of the first embodiment (FIGS. 1–5) I illustrate a valve body 10 having an inlet 11 into which the grain will flow. A principal outlet 12 is approximately in line vertically with the inlet 11. A secondary outlet 13 into which grain may be directed extends at an angle away from the vertical. Thus grain may come into the housing 10 from above through the inlet 11 and be directed into either outlet by a valve member.

Figure 5:
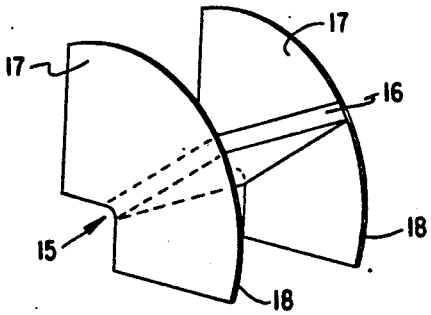
FIG. 5 is a perspective view of the valve member used in the valve shown in FIGS. 1–4.

Customarily the valve member has been a simple plate which might have been rimmed with a flexible material such as belting. In my improved device, I use a valve member 15 as shown in FIG. 5. A diversion plate 16 is retained, but side plates 17 are provided on each lateral edge of the plate 16. These side plates 17 are formed with an arcuate outer edge 18 adapted to fit into the housing 10 as is apparent in FIG. 2. It may be noted that the side walls of the housing 10 are also found in arcuate form. It might also be noted that no internal spout is necessary. The inlet 11 is simply an extension of the entry pipe (not shown).

The member 15 is mounted on a shaft 20 journalled in the side walls of the housing 10. Various means of turning the valve may be provided. The simplest is illustrated. It consists of a plate 21 fixed to the shaft 20. A cross beam 22 is fastened to the plate. Chains or ropes or the like may be fastened to each end of the cross beam 22, and these can be pulled selectively to control the position of the valve member 15 within the housing 10. It will be obvious that chains and sprocket devices or power operated devices such as geared motors may be substituted for the pull-type device.

Means for holding the valve member 15 in position is also provided. This consists of a lever 25 fastened to the axle 20 at its end opposite the plate 21. A spring 26 extends between the free end of that lever 25 and a tab 27 fixed to the housing 10. The positions of the tab 27 and lever 25 are arranged so that the free end of the lever pulls the spring 26 over the center as the valve member 15 moves from one position to its alternate position. Thus, the spring will tend to pull the valve member into either position and will be stretched longer between those positions.

In order to hold to plate 16 in position, stops 28 in the form of metal strips fastened to the upper wall of the housing 10 in position to be engaged by the plate.

The use of the device will be obvious from the description thus far. The principal benefit comes from the unique side walls 17. These walls are proportioned so that in either position of the valve member they completely cover the walls of the housing 10. Thus, the grain is completed enclosed in a trough formed by the plate 16 and the sidewalls 17 as it enters the housing 10 through the entry 11 and is directed through either outlet 12 or 13. Therefore, the grain cannot be leaked between the plate 16 and the walls of the housing 10. This greatly eliminates leakage of the grain. The side walls are substantially co-extensive with the sides of the housing 10 to avoid leakage. The moving part is also blocked by the strips 28 and can be held positively in place so that the force of the grain does not tend to move the valve member in any direction.

A simple alternate is shown in FIG. 6. Here the outlets 31 and 32 of the housing 30 are both directed at an angle from the vertical. The inlet 33 is still adapted to receive the grain vertically. The same type of valve member 15 may be used in the housing 30 with the same beneficial results.

Figure 7:
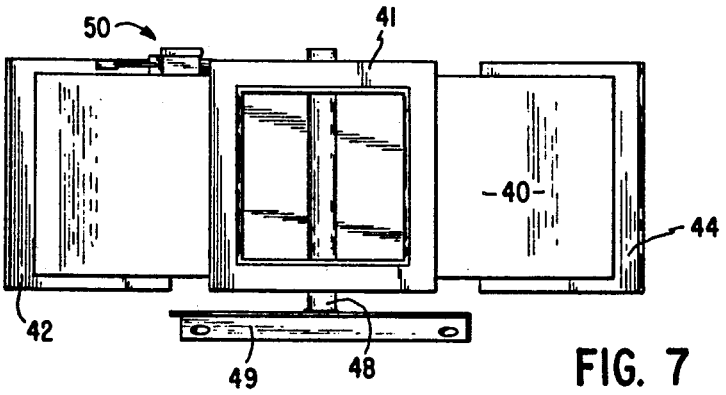
FIG. 7 is a top view of a three-way valve embodying the invention.
Figure 8:
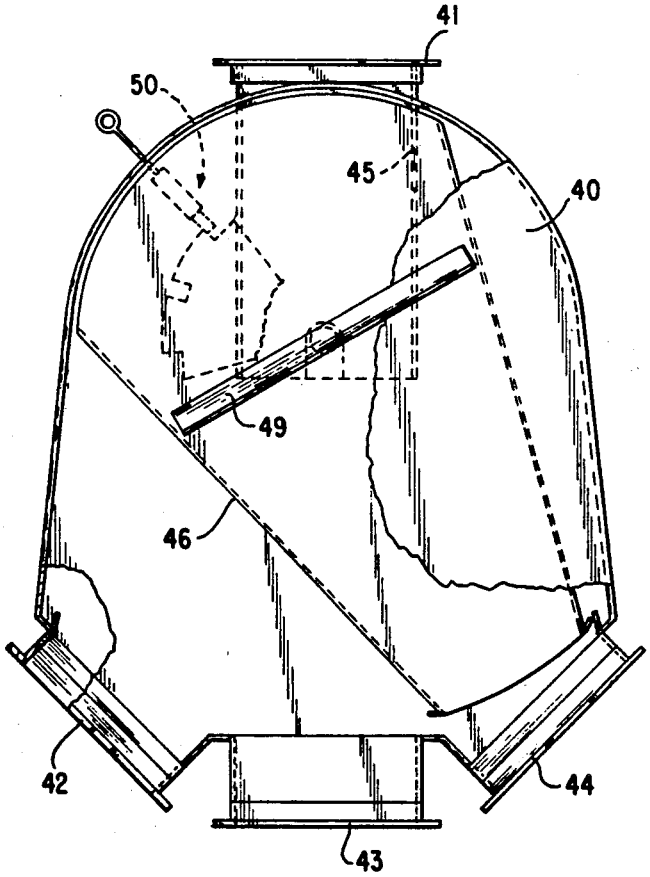
FIG. 8 is a side view of the valve of FIG. 7 with much of the side walls broken away to show underlying parts.
Figure 9:
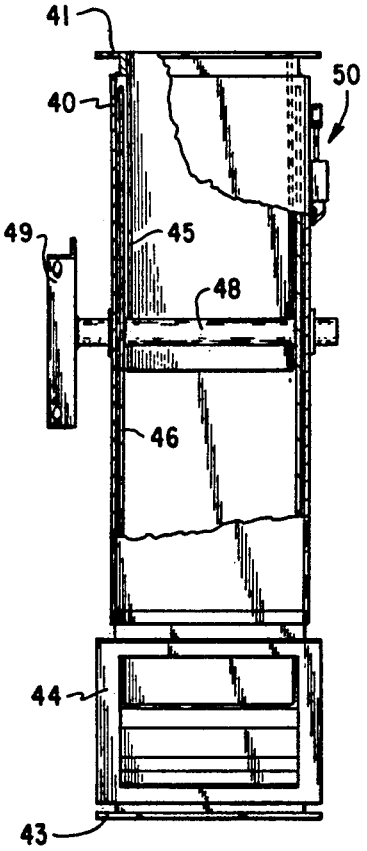
FIG. 9 is an edge view partly in section of the valve of FIG. 7.

A second alternative usable for a valve to deliver grain into three alternate chutes is illustrated in FIGS. 7–9. I this device, the housing 40 is designed with a single inlet 41 and three alternate outlets 42, 43, and 44. The inlet includes a spout or chute 45 extending into the housing 40 a substantial distance.

The valve member in the device is a complete internal chute 46. The inlet spout 45 extends well within the valve member 46 and therefore will always dump incoming grain into that valve member.

Movement of the valve member is provided by means similar to that of the first described embodiment. A shaft 48 is journalled in the walls of the housing 40. The valve member 46 is affixed to this shaft. A beam 49 similar to that of the first embodiment and operated in the same manner may be fixed to the shaft 48 to turn the valve member 46 to the desired position.

Figure 11:
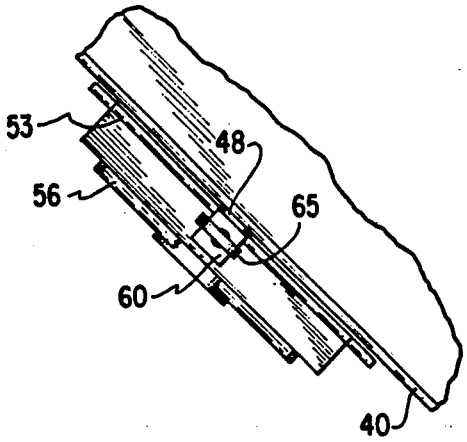
FIG. 11 is an edge view of the control means of FIG. 10.
Figure 10:
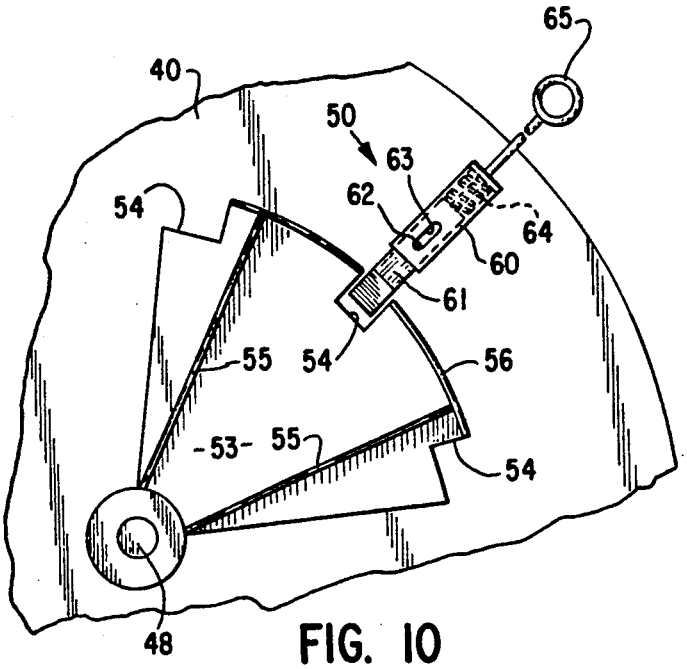
FIG. 10 is an elevational view to an enlarged scale showing the control means for the valve of FIG. 7.
Figure 12:
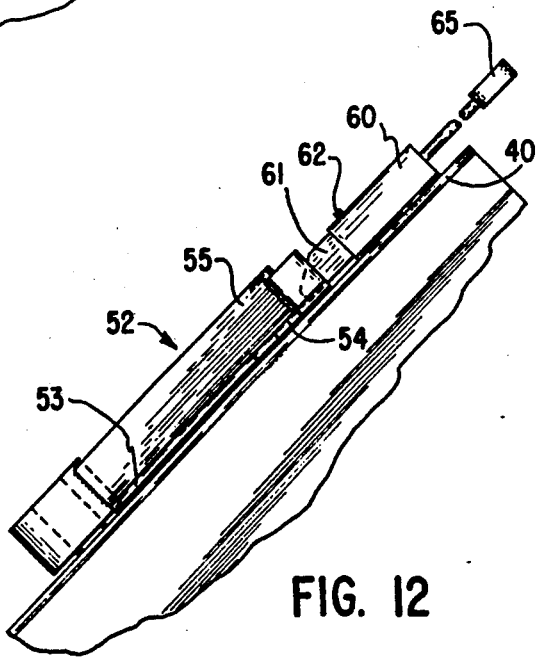
FIG. 12 is a side view of those control means.

The position retaining mechanism must, however, be different in this embodiment since an over-the-center mechanism readily accommodates only two positions. Therefore, the preferred device is a three-position latched device 50 shown in detail in FIGS. 10–12. This device is fixed to the housing 40 on the side opposite to the positioning lever 49.

A notched member 52 is fastened to the shaft 48. As illustrated, this member consists of a plate 53 formed with notches 54. Because the plate 53 by itself would be subject to bending, stiffening ribs 55 and a rim 56 may be welded onto the plate 53. The notches 54 are positioned and spaced to correspond to the various positions of the valve member chute 46 within the housing 40.

A latching device adapted to engage the notches 54 and thus to hold the valve member in position includes a sleeve-like enclosure 60 in which a latch member 61 is slidably journalled. Movement of the latch member 61 may be restricted by a pin 62 fixed to the member 61 and slidable within a slot 63 formed in the enclosure 60. A compression spring 64 with the enclosure 60 biases the member 61 to its outward extended position shown in the figures. To release the member 61 from the notches 54, a handle 65 is provided. This handle is illustrated as having a ring 66 so that it can be pulled by hand or by rope or the like to release the device. It will be recognized that other mechanical, electrical or hydraulic or pneumatic means could also serve this purpose.

Again the use of the three-position device will be obvious from the description. Also, again, the principal advantage will be seen to be the avoidance of leakage of grain or other product between the walls of the housing relative to which the valve member moves. Again, the cracking and crushing of grain is avoided, leakage is totally avoided, and movement of the valve member is eased because no grain is interposed between the valve member and the housing.

I claim as my invention:

1. A grain valve comprising a housing having side walls, an inlet formed in said housing adapted to receive grain from an outside source, two alternate outlets adapted to deliver said grain to alternate receiving devices, a valve member mounted in said housing, said valve member being in position to receive grain from said inlet and to direct said grain selectively to the alternate outlets, said valve member including means to enclose said grain to prevent contact of said grain with said side walls of the housing, and means to bias said valve member toward one of said outlets including spring means attached to said valve member, said spring means being arranged to provide biassing toward either outlet and away from an intermediate position.

* * * * *